US007430997B2

(12) United States Patent
Muraji et al.

(10) Patent No.: US 7,430,997 B2
(45) Date of Patent: Oct. 7, 2008

(54) VARIABLE VALVE OPERATING DEVICE FOR ENGINE

(75) Inventors: Tetsuo Muraji, Odawara (JP); Yukinori Nishimoto, Odawara (JP); Hiroto Uchi, Odawara (JP); Hideki Shono, Odawara (JP)

(73) Assignee: MIKUNI Corporation, Tokyo (JP)

( * ) Notice: Subject to any disclaimer, the term of this patent is extended or adjusted under 35 U.S.C. 154(b) by 74 days.

(21) Appl. No.: 10/588,483

(22) PCT Filed: Feb. 4, 2005

(86) PCT No.: PCT/JP2005/001715

§ 371 (c)(1),
(2), (4) Date: Aug. 4, 2006

(87) PCT Pub. No.: WO2005/075798

PCT Pub. Date: Aug. 18, 2005

(65) Prior Publication Data

US 2007/0163524 A1 Jul. 19, 2007

(30) Foreign Application Priority Data

Feb. 6, 2004 (JP) ..... 2004-030575

(51) Int. Cl.
*F01L 1/34* (2006.01)

(52) U.S. Cl. ..... 123/90.16; 123/90.15; 123/90.27

(58) Field of Classification Search ..... 123/90.16, 123/90.15, 90.27
See application file for complete search history.

(56) References Cited

U.S. PATENT DOCUMENTS

| | | | | |
|---|---|---|---|---|
| 4,285,810 | A | 8/1981 | Kirkland et al. | |
| 2002/0023603 | A1 * | 2/2002 | Nohara et al. | 123/90.15 |

FOREIGN PATENT DOCUMENTS

| | | |
|---|---|---|
| JP | 54-153919 | 12/1979 |
| JP | 64-53009 | 3/1989 |
| JP | 6-74011 | 3/1994 |
| JP | 11-132021 | 5/1999 |
| JP | 2002-89215 | 3/2002 |

* cited by examiner

*Primary Examiner*—Zelalem Eshete
(74) *Attorney, Agent, or Firm*—Wenderoth, Lind & Ponack, L.L.P.

(57) ABSTRACT

A variable valve operating device is provided that can swiftly adjust a valve timing of an engine and is for adjusting a valve lift and the valve timing of the engine. The variable valve operating device includes a rocking cam, a rocking cam support member, a valve, a rocking position changing unit, and a lock unit that can fix the rocking cam support member so as not to move during a valve-opening period of the valve. The lock unit includes a support base that movably supports the rocking cam support member, and a push-link which is rocked by an actuator. When a tip end of the push-link abuts against the rocking cam support member, the push-link pushes the rocking cam support member toward the support base.

18 Claims, 13 Drawing Sheets

(A)

(B)

(C)

(D)

(A)

(B)

(C)

(A)

(B)

(C)

(A)

(B)

(C)

(A)

(B)

(A)

(B)

(C)

VARIABLE VALVE OPERATING DEVICE FOR ENGINE

BACKGROUND OF THE INVENTION

1. Field of the Invention

The present invention relates to a variable valve operating device for an engine to adjust an opening and closing timing and a valve lift amount of an intake valve and an exhaust valve provided in the engine. More particularly, the invention relates to an adjusting device of a valve lift and a valve timing of an engine in which a valve timing cannot be adjusted during a valve-opening period of the intake valve, the exhaust valve, and the like, and the valve timing can be adjusted during a valve-closing period thereof.

2. Description of the Related Art

As a conventional configuration for opening and closing an intake valve and an exhaust valve provided in an engine, it is general to apply a rocking motion to a rocker arm by a cam provided on a rotatable cam shaft, and to push valve tappets of the intake valve and the exhaust valve by a tip end of the rocker arm, thereby opening and closing the intake valve and the exhaust valve. As a configuration for adjusting the valve lift and the valve timing corresponding to an output of the engine, a configuration for adjusting a lever ratio by moving a fulcrum of the rocker arm is employed (For example, see Patent Document 1: Japanese Patent Application Laid-Open No. S64-53009 and Patent Document 2: Japanese Patent Application Laid-Open No. H6-74011).

According to the configuration for adjusting the valve lift and the valve timing in the Patent Documents 1 and 2, a rocker arm which is rocked by a cam of a cam shaft to open and close the intake valve and the exhaust valve, and a fulcrum of a rocking cam are moved to change and adjust the lever ratio. However, this is not a configuration in which the fulcrum is fixed when the intake valve and the exhaust valve are opened and the fulcrums can be moved when the valves are closed.

When the intake valve and the exhaust valve are opened, it is necessary to fix the rocker arm and the fulcrum of the rocking cam so as not to move so that the intake valve and the exhaust valve can be opened in a stable state. To enhance the responding speeds of adjustments of the valve lift and the valve timing, it is desirable to adjust the movement of the fulcrum when the intake valve and the exhaust valve are closed.

Hence, one approach is to configure a lock unit that locks the fulcrum of the rocking cam and the like so as not to move at the time of opening the valves using a retarder that uses a solenoid. However, it is necessary to demagnetize the retarder when the fulcrum is unlocked thus requiring control thereof and time therefor, which becomes a problem in enhancing the responding speed.

SUMMARY OF THE INVENTION

The present invention has been achieved in view of the above problems. According to the present invention, there is provided a variable valve operating device for an engine to adjust a valve lift and a valve timing of the engine, including a rocking cam which is rocked by a cam provided on a rotatable cam shaft, a rocking cam support member that rockably supports the rocking cam, a valve which is opened and closed by a rocking motion of the rocking cam, a rocking position changing unit that moves the rocking cam support member to change a lever ratio of the rocking cam and that changes a rocking position of the rocking cam, and a lock unit that can fix the rocking cam support member so as not to move during a valve-opening period of the valve.

In the variable valve operating device for the engine according to the invention, the lock unit includes a support base that movably supports the rocking cam support member, and a push-link which is rocked by an actuator and which pushes the rocking cam support member toward the support base when a tip end side of the push-link abuts against the rocking cam support member.

In the variable valve operating device for the engine of the invention, the lock unit includes a support base that movably supports the rocking cam support member, and a push-link which is rocked by a switch cam integrally formed on the rocking cam and which pushes the rocking cam support member toward the support base when a tip end side of the push-link abuts against the rocking cam support member.

In the variable valve operating device for the engine of the invention, the tip end side abuts against the rocking cam support member in a state where the push-link is slightly inclined from a vertical state with respect to the rocking cam support member.

In the variable valve operating device for the engine of the invention, the lock unit includes a lock cam which can turn in association with a valve opening turning motion of the rocking cam, in which the lock cam includes a stopper which is pushed against a fixed portion when the lock cam is turned by a predetermined amount.

In the variable valve operating device for the engine of the invention, the rocking position changing unit includes a turnable control shaft, and a push moving positioning member that pushes and moves the rocking cam support member to position it by turning the control shaft to change a rocking position of the rocking cam.

In the variable valve operating device for the engine of the invention, the push moving positioning member is turnably provided on the control shaft, and a biasing unit that holds the push moving positioning member at a predetermined position is provided between the control shaft and the push moving positioning member.

In the variable valve operating device for the engine of the invention, an energy-storing mechanism that stores energy for moving the rocking cam support member is provided between the push moving positioning member and the rocking cam support member.

In the variable valve operating device for the engine of the invention, a common control shaft is provided with the valves and push moving positioning members in equal numbers.

In the variable valve operating device for the engine of the invention, a turning unit that turns the control shaft includes a manual wire or an actuator.

According to the present invention, there is also provided a variable valve operating device for an engine to adjust a valve lift and a valve timing of the engine. The operating device includes a rocking cam which is rocked by a cam provided on a rotatable cam shaft, a rocking cam support member that rockably supports the rocking cam, a valve which is opened and closed by a rocking motion of the rocking cam, a rocking position changing unit that moves the rocking cam support member to change a rocking position of the rocking cam, and a lock unit that can fix the rocking cam support member so as not to move during a valve-opening period of the valve. The rocking cam support member is disposed between a movable element which is movably provided on the rocking position changing unit and a fixed portion fixed to the rocking position changing unit, and the rocking cam support member is provided between a restriction surface provided on the movable element and the fixed portion such that the rocking cam support member can be sandwiched and fixed therebetween.

In the variable valve operating device for the engine of the invention, the rocking cam support member is provided at both ends with rocking cams such that the rocking cams can rock, and a cross sectional shape of a central portion of the rocking cam support member includes a narrow portion which is narrower than a distance size between the restriction surface of the movable element and the fixed portion, and a wide portion which is slightly wider than the distance size.

In the variable valve operating device for the engine of the invention, the movable element includes a positioning portion which can abut against the rocking cam support member at a position away from the restriction surface.

According to the present invention, the rocking cam support member that supports the rocking cam that opens and closes the valve by being rocked by the cam provided on the cam shaft is fixed by the lock unit so as not to move during the valve-opening period (opening operation) of a valve such as an intake valve and an exhaust valve provided in an engine. When the valve is to be closed, the fixed state of the rocking cam support member by the lock unit is released, and the rocking cam support member can be moved and adjusted.

Thus, the valve is precisely opened with a lever ratio of the rocking cam which is preset by the position of the rocking cam support member. The position of the rocking cam support member is adjusted when the valve is closed, and the opening and closing timing of the valve can be swiftly adjusted.

According to the invention, since the lock unit can fix the rocking cam support member utilizing a wedge effect or a toggle link effect, it is possible to generate a great pushing force, and the rocking cam support member can be reliably fixed.

DETAILED DESCRIPTION OF THE INVENTION

Embodiments of the present invention are explained below with reference to the drawings. Since a configuration of an engine, a supporting configuration of a cam shaft, a configuration for rotating the cam shaft, and the like are already known, configurations of relevant parts of the present invention will be explained while showing them conceptually and schematically.

As is well known, a cylinder head of an engine includes an intake hole and an exhaust port. The intake hole includes an intake valve for opening and closing the intake hole. An exhaust hole includes an exhaust valve for opening and closing the exhaust hole.

In this specification, the intake hole and the exhaust hole are collectively called an "intake and exhaust hole", and the intake valve and the exhaust valve are collectively called a "valve" or an "opening and closing valve".

Figure 1:
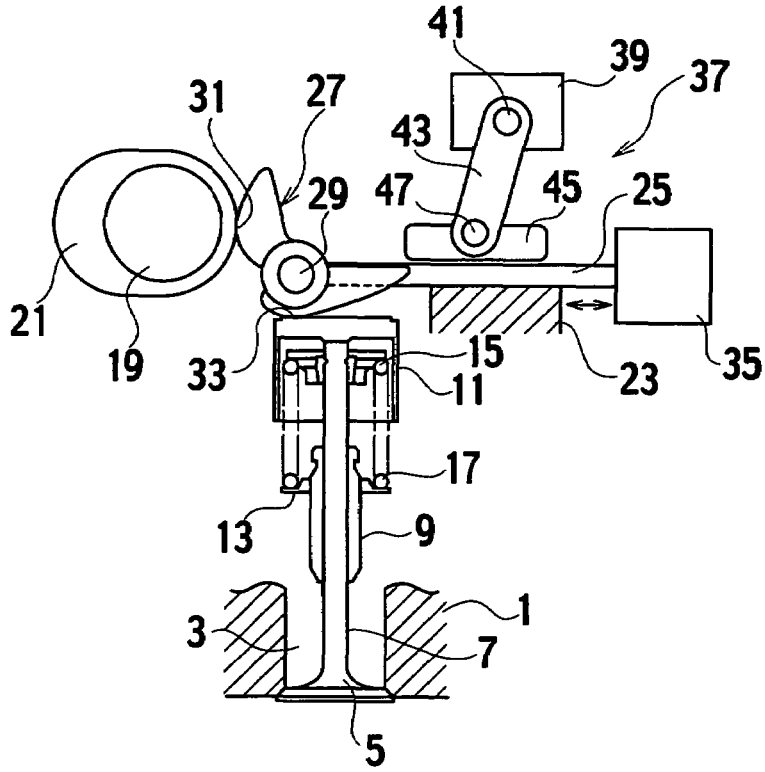
FIG. 1 is a conceptual and schematic explanatory diagram of a variable valve operating device according to a first embodiment of the present invention.
Figure 2:
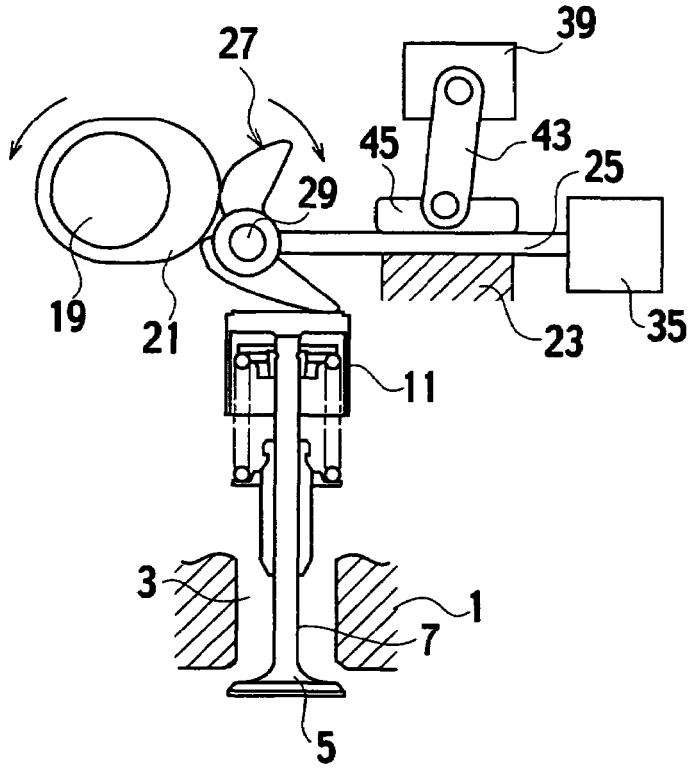
FIG. 2 is a conceptual and schematic explanatory diagram of the variable valve operating device according to the first embodiment of the invention.

With reference to FIGS. 1 and 2, a cylinder head 1 of an engine (not shown) includes an intake and exhaust hole 3, and the intake and exhaust hole 3 includes an opening and closing valve 5 that opens and closes the intake and exhaust hole 3. A stem 7 of the opening and closing valve 5 is vertically movably guided and supported by a stem guide 9 provided on the cylinder head 1. The stem 7 includes a cup-like lifter 11 at an upper end thereof.

A valve spring 17 is resiliently provided between a spring seat 13 provided in the stem guide 9 and a spring seat 15 provided in the lifter 11. The opening and closing valve 5 is always biased by the valve spring 17 upward, that is, in a direction in which the intake and exhaust hole 3 is closed.

The opening and closing valve 5 and a configuration for vertically movably supporting the opening and closing valve 5 with respect to the cylinder head 1 may be a known valve and configuration, and thus detailed explanation of the opening and closing valve 5 and its supporting configuration will be omitted.

The cylinder head 1 includes a rotatable cam shaft 19. The cam shaft 19 includes the same number of cams 21 as that of the opening and closing valves 5. The intake valve and the exhaust valve respectively have the cam shafts 19.

Since a driving system for rotating the cam shaft 19 is known, detailed configuration, effect, and the like of the driving system for rotating the cam shaft 19 will be omitted. Further, since a relation between the intake valve and the cam shaft corresponding to the intake valve, and a relation between the exhaust valve and the cam shaft corresponding to the exhaust valve are substantially the same, one of the relations will be shown conceptually and schematically for the explanation thereof.

An adjusting mechanism is provided between the cam shaft 19 and the opening and closing valve 5 for adjusting a valve lift and a valve timing (timing of opening and closing motion) of the opening and closing valve 5. The cylinder head 1 includes a support base 23 at one portion thereof. A rocking cam support member 25 is supported by the support base 23 while being able to approach to and move away from the cam shaft 19. A rocking cam 27 which is rocked by the cam 21 is rockably supported by a tip end of the rocking cam support member 25.

More specifically, the rocking cam support member 25 is provided at a position lower than a center position of the cam shaft 19 in a direction (horizontal direction) perpendicular to a direction of the opening and closing motion of the opening and closing valve 5 (vertical direction in FIG. 1) such that the rocking cam support member 25 can approach to and move away from the cam shaft 19. The rocking cam support member 25 includes a horizontal support shaft 29 at its tip end in a direction perpendicular to a moving direction of the rocking cam support member 25. The rocking cam 27 is rockably (turnably) supported by the support shaft 29.

That is, the center position of the support shaft 29 is adjusted in a direction in which the support shaft 29 approaches to and moves away from the cam shaft 19 at a height position between an axis of the cam shaft 19 and an upper surface of the lifter 11.

The rocking cam 27 has a cam contact surface 31 which is always in contact with (abutment against) the cam 21, and a lifter contact surface 33 which is always in contact with (abutment against) the upper surface of the lifter 11. The rocking cam 27 is formed into a substantially bellcrank shape as a whole. The cam contact surface 31 and the lifter contact surface 33 are formed into desired cam surfaces.

With the above configuration, if the cam contact surface 31 of the rocking cam 27 is pushed by the cam 21 by the rotation of the cam shaft 19 and the rocking cam 27 is turned (rocked) in a clockwise direction in FIG. 1, the lifter contact surface 33 pushes the lifter 11 downward against the biasing force of the valve spring 17. Therefore, the opening and closing valve 5 is opened as shown in FIG. 2. If the cam shaft 19 is further turned into the same direction, the opening and closing valve 5 is closed by the effect of the valve spring 17 as shown in FIG. 1. That is, the opening and closing valve 5 is opened and closed by the rotation of the cam shaft 19.

If the rocking cam support member 25 is moved in a lateral direction in FIG. 1, the support shaft 29 moves in a direction approaching to or moving away from the cam shaft 19, the lever ratio of the rocking cam 27 is adjusted, and the lift amount and valve timing of the opening and closing valve 5 can be adjusted. That is, if the rocking cam support member 25 is moved leftward in FIG. 1, the lift amount of the opening and closing valve can be increased, and if the rocking cam support member 25 is moved rightward, and the lift amount of the opening and closing valve 5 can be reduced.

The variable valve operating device has a rocking position changing unit 35 that moves and positions the rocking cam support member 25 in the lateral direction in FIG. 1 and changes a rocking position of the rocking cam 27, that is, a position of the support shaft 29. The rocking position changing unit 35 is an actuator such as a linear motor and a servomotor, and is connected to the rocking cam support member 25.

Therefore, the rocking cam support member 25 can be moved in the lateral direction in FIG. 1 and positioned by the rocking position changing unit 35. The position of the support shaft 29 is changed by driving the rocking position changing unit 35 when the opening and closing valve 5 is closed (closed state).

When the rocking cam 27 is rocked by the cam 21 to open or close the opening and closing valve 5 as described above, there is a tendency that the rocking cam support member 25 is pushed rightward in FIG. 1. At that time, it is necessary to precisely hold the turning center position of the rocking cam 27 at a positioned location.

The variable valve operating device includes a lock unit 37 that can fix the rocking cam support member 25 so as not to move after the rocking cam support member 25 and the support shaft 29 are moved and positioned by the rocking position changing unit 35. The lock unit 37 is operated during a valve-opening period (opening state) of the opening and closing valve 5, and fixes the rocking cam support member 25 so as not to move.

More precisely, it is preferable that the lock unit 37 is operated during a period from immediately before the opening and closing valve 5 is opened until the opening and closing valve 5 is closed.

The lock unit 37 includes an appropriate locking actuator (external force applying unit) 39 such as a rotary solenoid mounted on an appropriate position of the cylinder head 1. The locking actuator 39 turns a turning shaft 41. A base end of a push-link 43 for pushing the rocking cam support member 25 against the support base 23 and fixing the rocking cam support member 25 is fixed to the turning shaft 41. A push-pad 45 is pivotally mounted on a tip end of the push-link 43 through a pivot 47. The push-pad 45 abuts against the rocking cam support member 25 to push the rocking cam support member 25 toward the support base 23.

The length of the push-link 43 is set such that when the push-pad 45 pushes the rocking cam support member 25 against the support base 23 and fixes the rocking cam support member 25, the tip end of the push-link 43 is slightly inclined with respect to a vertical line such that the tip end of the push-link 43 is positioned on the side of the cam shaft 19.

With the above configuration, if the locking actuator 39 as one example of an external force applying unit is operated to turn the push-link 43 in a counterclockwise direction, the push-pad 45 abuts against an upper surface of the rocking cam support member 25 and pushes the rocking cam support member 25 toward the support base 23 and fixes the rocking cam support member 25 (see FIG. 2). That is, an external force is applied to the rocking cam support member 25 to fix the rocking cam support member 25.

When the rocking cam 27 is pushed and turned by the cam 21, if there is a tendency that the rocking cam support member 25 is moved rightward in FIG. 2, there is a tendency that the push-pad 45 moves integrally with the rocking cam support member 25 and the push-link 43 is oriented more vertically, thereby generating a wedge effect or a toggle link effect. Therefore, the force of the push-pad 45 pushing the rocking cam support member 25 against the support base 23 is increased, and the rocking cam support member 25 can be fixed more reliably so as not to move.

If the push-link 43 is then slightly turned in the clockwise direction by the operation of the locking actuator 39, the pushed and fixed state by the push-pad 45 is released (see FIG. 1), the rocking cam support member 25 can be moved in the lateral direction in FIG. 1 and positioned, and the rocking cam support member 25 can be moved and positioned by the rocking position changing unit 35.

It is necessary to know the open and close state of the opening and closing valve 5 to control the operations of the rocking position changing unit 35 and the locking actuator 39. Hence, the cam shaft 19 includes a rotation position detector (not shown) such as a rotary encoder that detects a rotation position of the cam shaft 19 from a reference position (original position) and also includes an appropriate position detector (not shown) such as a linear position sensor that detects a moving position of the rocking cam support member 25 to detect a moving position of the support shaft 29 with respect to the reference position. The variable valve operating device further includes a calculator (not shown) that calculates a lift amount of the opening and closing valve 5 based on a detection value of the rotation position detector, a detection value of the position detector, and shapes of the cam contact surface 31 and the lifter contact surface 33 of the rocking cam 27.

Therefore, by detecting the rotation position of the cam shaft 19 and the position of the support shaft 29, it is possible to know the state of the opening and closing motion of the opening and closing valve 5. Moreover, it is possible to fix the rocking cam support member 25 by the lock unit 37 so as not to move at the time of the opening operation of the opening and closing valve 5, to release the fixed state by the lock unit 37 at the time of the closing operation of the opening and closing valve 5, and to move and position the support shaft 29 under the operation of the rocking position changing unit 35.

As can be understood already, with the above configuration, it is possible to firmly mechanically fix the rocking cam support member 25, and to miniaturize the locking actuator 39. Since the rocking cam support member 25 can be fixed firmly, it is possible to precisely hold the position of the positioned support shaft 29 at a set position, and an accurate control can be performed while the lift amount of the opening and closing valve 5 is stable.

Since the push-pad 45 can be slightly lifted and separated from the upper surface of the rocking cam support member 25, the influence of viscosity resistance when the rocking cam support member 25 is moved can be reduced, and the rocking cam support member 25 can be moved more swiftly.

Figure 3:
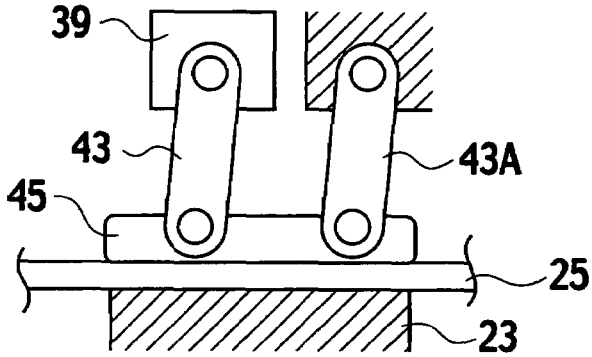
FIGS. 3(A), (B), (C), and (D) are explanatory diagrams of configurations of various modifications of a lock unit.
Figure 3:
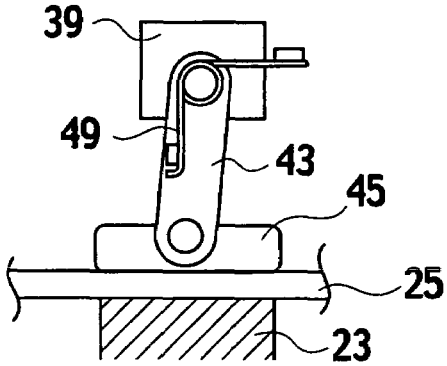
Figure 3:
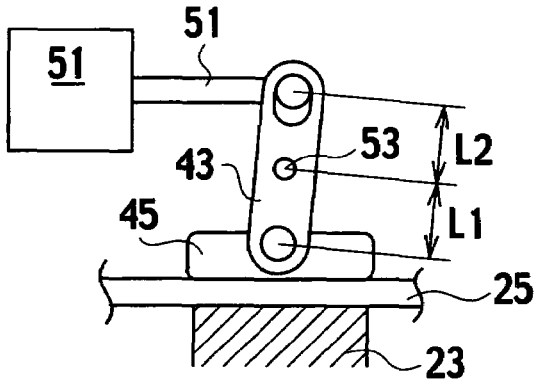
Figure 3:
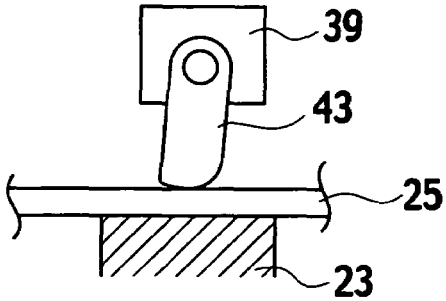

FIGS. 3(A), (B), (C) and (D) show various modifications of the lock unit 37. Like reference signs denote constituent elements having the same functions as those of the above embodiment, and redundant explanation will be omitted.

FIG. 3(A) shows an embodiment in which a parallel link 43A which is in parallel to the push-link 43 is provided and the push-pad 45 is supported by a parallel link mechanism. According to this embodiment, the same effect as that of the above embodiment can be obtained, and since the push-pad 45 is vertically moved while always maintaining the horizontal state, the posture of the push-pad 45 is stabilized.

FIG. 3(B) shows an embodiment in which the variable valve operating device includes a biasing unit 49 such as a torsion spring, and the push-link 43 is biased such that the push-pad 45 is separated from the rocking cam support member 25. According to this embodiment, since a state where the push-pad 45 is separated from the rocking cam support member 25 can be held by the effect of the biasing unit 49 at the time of unlocking, the power consumption of the locking actuator 39 can be reduced.

FIG. 3(C) shows an embodiment in which the locking actuator is a linear motion type locking actuator 51, the push-link 43 can freely turn around a pivot 53, and a long hole formed in an upper end of the push-link 43 and a tip end of an operation rod 51R which is provided in the locking actuator 51 such as to be able to reciprocate pivotally are connected to each other. With this configuration, an arm length ratio L2/L1 of the push-link 43 can be optimized according to a generated load, a responding speed, and the like of the locking actuator 51.

FIG. 3(D) shows an embodiment in which the push-pad 45 is omitted, a tip end of the push-link 43 is appropriately formed into a cam surface, and the cam surface comes into direct contact with an upper surface of the rocking cam support member 25. With this configuration, the configuration can be simplified.

Figure 4:
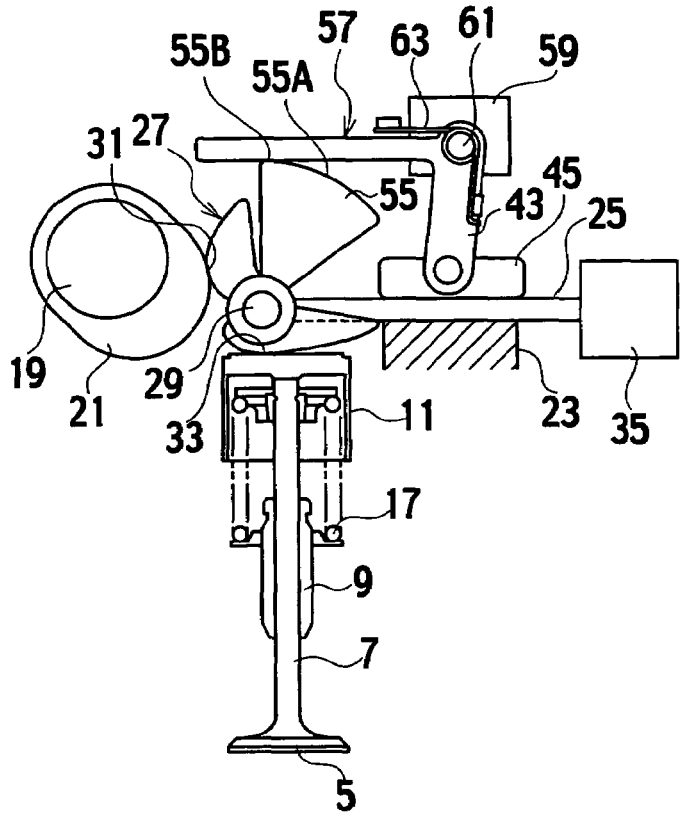
FIG. 4 is a conceptual and schematic explanatory diagram of a configuration according to a second embodiment.
Figure 5:
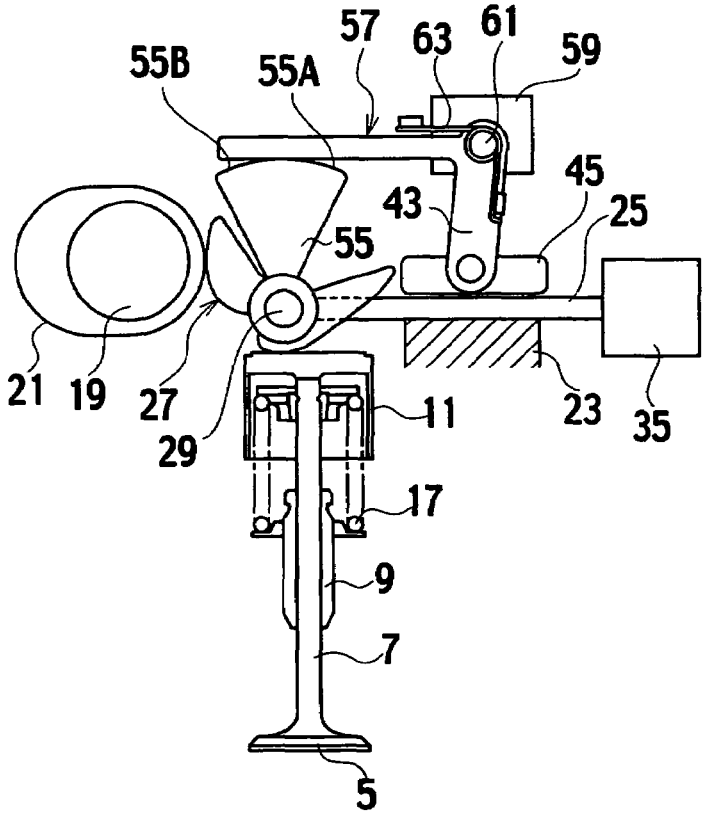
FIG. 5 is a conceptual and schematic explanatory diagram of the configuration according to the second embodiment.

FIGS. 4 and 5 show a second embodiment of the present invention. Like reference signs denote constituent elements having the same functions as those of the above embodiment, and redundant explanation will be omitted.

In the second embodiment, the rocking cam 27 is integrally provided with a switch cam 55, a bellcrank-shaped rocker arm 57 is integrally provided with the push-link 43, and the rocker arm 57 is supported through a pivot 61 by a bracket 59 provided on a portion of the cylinder head such that the rocker arm 57 can rock. A biasing unit 63 such as a torsion spring is provided on a portion of the pivot 61, and the rocker arm 57 is always biased in the counterclockwise direction in FIGS. 4 and 5.

Therefore, the rocker arm 57 is supported substantially horizontally, and the rocker arm 57 is always in slide contact with a cam surface of the switch cam 55. The switch cam 55 controls the rocking motion of the rocker arm 57, and fixes the rocking cam support member 25 by the push-pad 45 and releases the fixed state.

That is, as shown in FIG. 5, when the opening and closing valve 5 is in a closing operation state, the rocker arm 57 is turned in the counterclockwise direction against the biasing force of the biasing unit 63, and a first cam surface 55A which holds the push-pad 45 in a state slightly lifted from the rocking cam support member 25 (unlocked state) is formed on the switch cam 55. When the opening and closing valve 5 is in an opening operation state, a second cam surface 55B which holds the push-pad 45 in a locked state where the push-pad 45 pushes and fixes the rocking cam support member 25 by the biasing force of the biasing unit is formed on the switch cam 55.

The first cam surface 55A of the switch cam 55 corresponds to the rocker arm 57 when the opening and closing valve 5 is in the closing operation state. The first cam surface 55A is formed into an arc having a constant radius from an axis of the support shaft 29. When the opening and closing valve 5 is in the opening operation state, the second cam surface 55B corresponds to the rocker arm 57. The second cam surface 55B is formed into a curved surface whose radius of curvature is gradually reduced as the opening and closing valve 5 is separated from an end of the first cam surface 55A.

With the above configuration, if the rocking cam 27 is turned (rocked) around the support shaft 29 by the cam 21 by the rotation of the cam shaft 19, the lifter 11 is vertically moved to open and close the opening and closing valve 5 as described above. If the opening and closing valve 5 is brought into the closing operation state, the first cam surface 55A of the switch cam 55 which is integrally turned together with the rocking cam 27 corresponds to the rocker arm 57, and the pushed and fixed state of the rocking cam support member 25 by the push-pad 45 is released as shown in FIG. 5. When the opening and closing valve 5 is brought into the opening operation state and the second cam surface 55B of the switch cam 55 corresponds to the rocker arm 57, the rocker arm 57 is slightly turned in the counterclockwise direction from the state shown in FIG. 5, and the rocking cam support member 25 is pushed and fixed by the push-pad 45 as shown in FIG. 4.

As can be understood from the above explanation, in the second embodiment, the locking actuator 39 is omitted, and the rocking cam support member 25 is fixed and its fixed state is released mechanically in association with the turning motion of the rocking cam 27. According to the second embodiment, the same effect as that of the first embodiment can be obtained, and since the locking actuator can be omitted, the configuration can be simplified.

Figure 6:
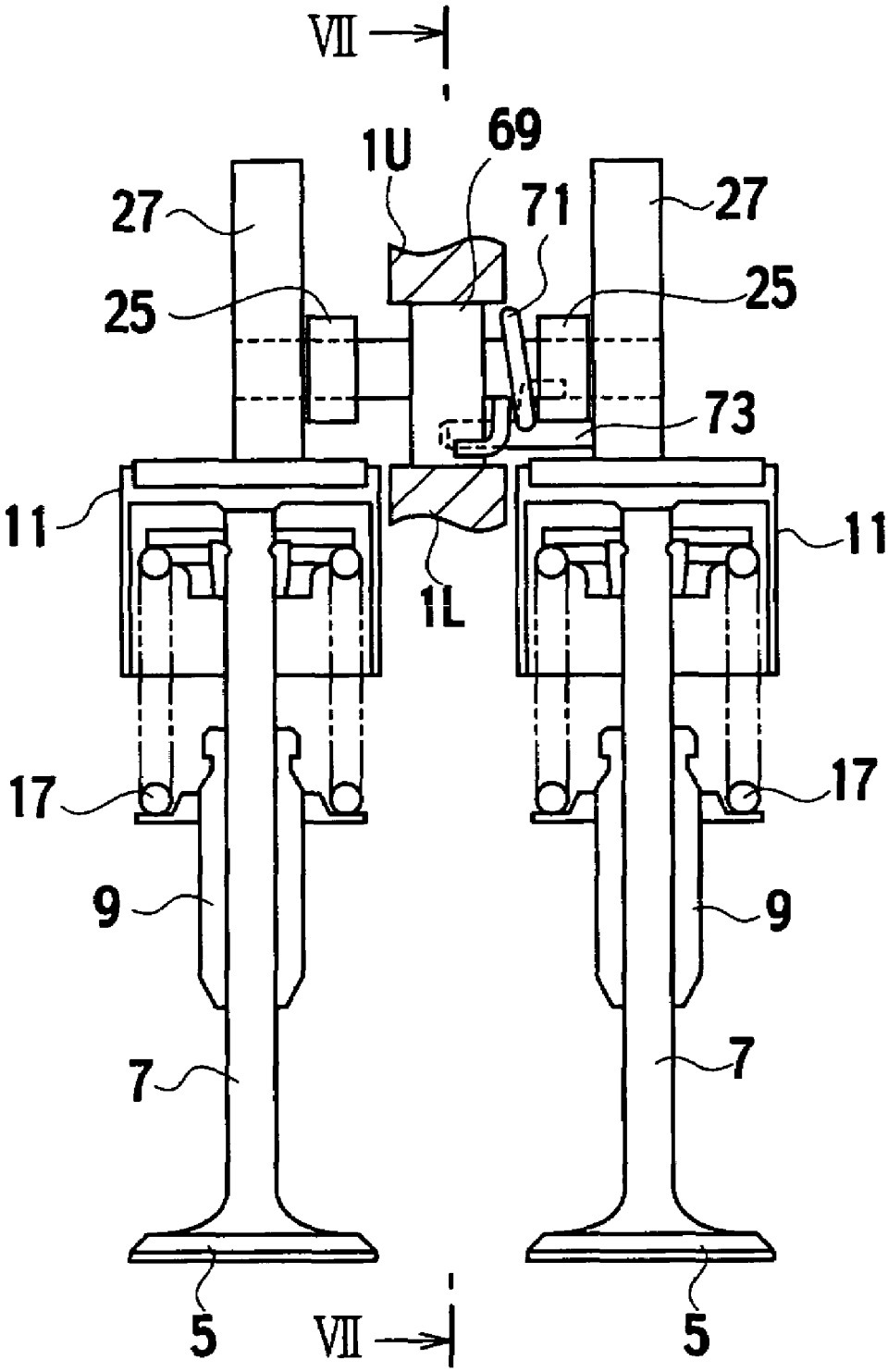
FIG. 6 is a conceptual and schematic explanatory diagram of a configuration according to a third embodiment.
Figure 7:
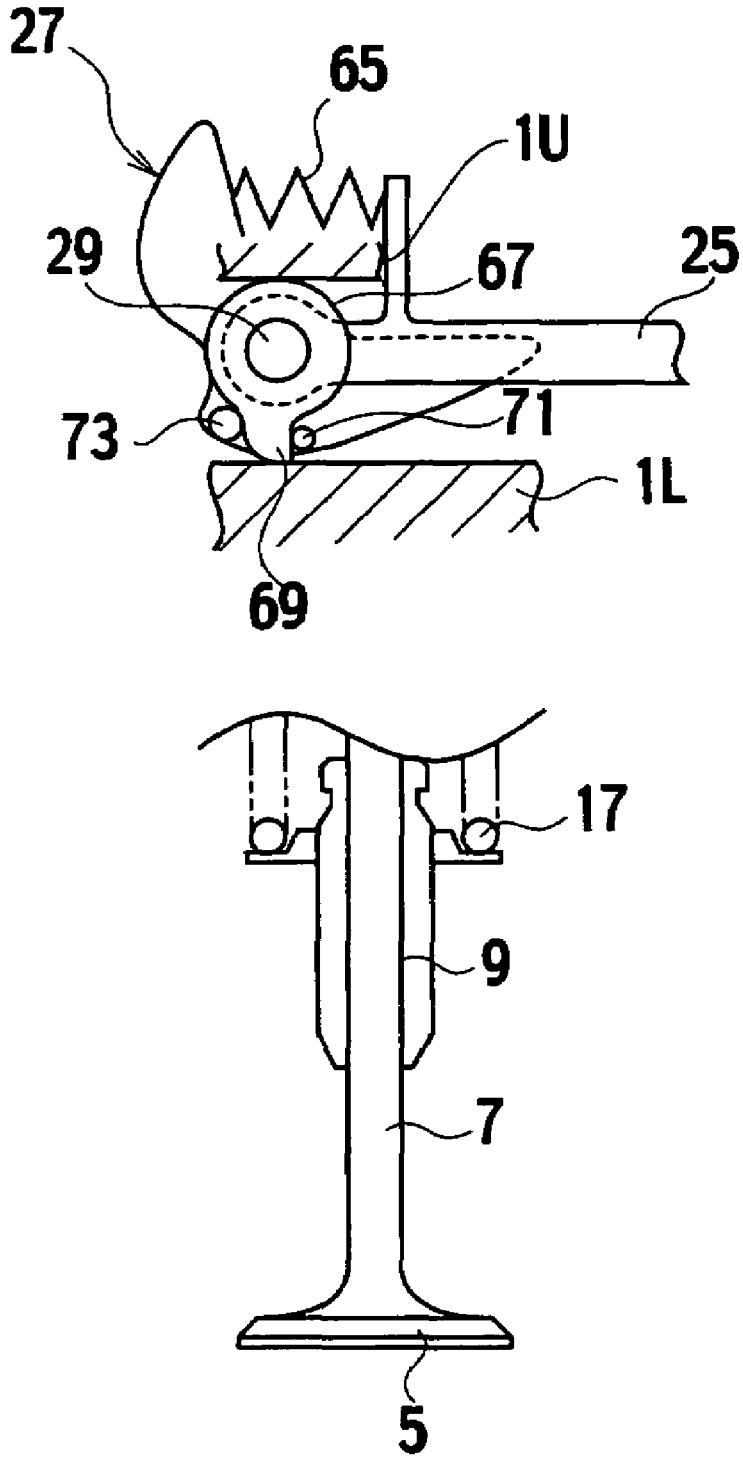
FIG. 7 is a cross section of relevant parts taken along line VII-VII in FIG. 6.

FIGS. 6 and 7 show a third embodiment of the present invention. Like reference signs denote constituent elements having the same functions as those of the above embodiments, and redundant explanation will be omitted.

In the third embodiment, a resilient member 65 such as a spring is resiliently provided between the rocking cam support member 25 and the rocking cam 27, the rocking cam 27 is biased in the counterclockwise direction in FIG. 7, and a lock cam 67 is turnably mounted on the support shaft 29.

The lock cam 67 is disposed between upper and lower fixing wall portions 1U and 1L formed on the cylinder head 1. A stopper 69 projects from the lock cam 67. A tip end of the stopper 69 which is formed into an appropriate cam surface can be abutted against and fixed to an upper surface of the lower fixing wall portion 1L. A resilient member 71 such as a torsion spring which biases the lock cam 67 in the clockwise direction in FIG. 7 is provided between the rocking cam support member 25 and the lock cam 67.

The rocking cam 27 includes a restriction pin 73 which abuts against the stopper 69 of the lock cam 67 to restrict the turning motion of the lock cam 67 in the clockwise direction in a normal state. A biasing force of the resilient member 65 that biases the rocking cam 27 in the counterclockwise direction in FIG. 7 is set stronger than a biasing force of the resilient member 71 that biases the lock cam 67 in the clockwise direction.

Figure 8:
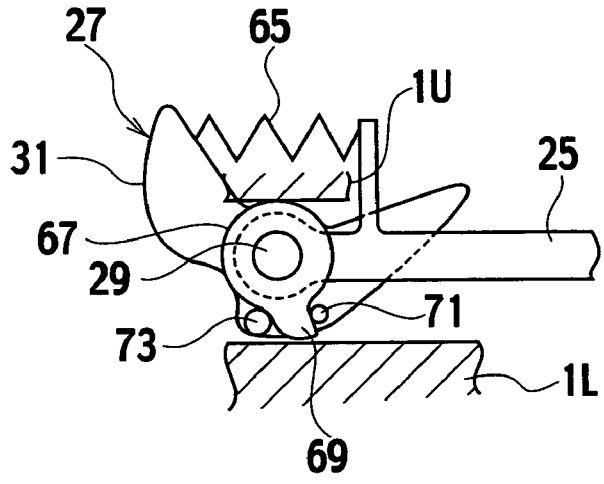
FIGS. 8(A), (B), and (C) are explanatory diagrams of operation of a lock apparatus according to the third embodiment.
Figure 8:
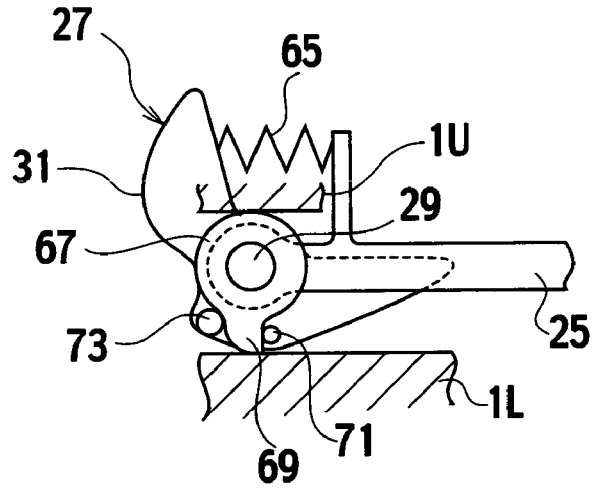
Figure 8:
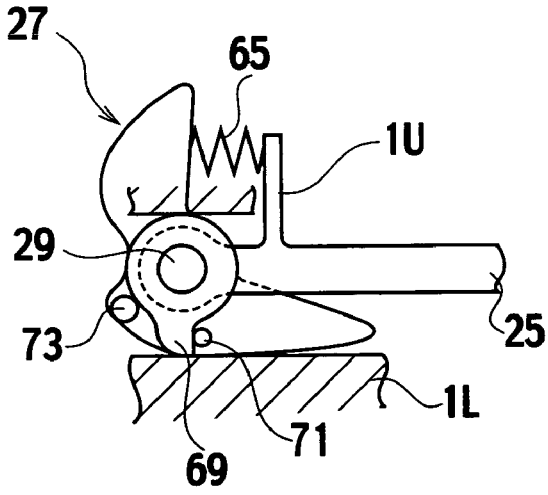

Therefore, in a state in which the cam 21 (not shown in FIGS. 8(A), (B) and (C)) of the cam shaft 19 does not push the cam contact surface 31 of the rocking cam 27, that is, in the closing state of the opening and closing valve 5, the rocking cam 27 is turned in the counterclockwise direction by the effect of the resilient member 65 as shown in FIG. 8(A), and the lock cam 67 is turned in the counterclockwise direction against the biasing force of the resilient member 71 through the restriction pin 73 of the rocking cam 27. That is, the stopper 69 of the lock cam 67 is separated from the upper surface of the lower fixing wall portion 1L, and the rocking cam support member 25 can freely move in the lateral direction in FIG. 8(A).

If the cam shaft 19 is rotated, the cam 21 pushes the cam contact surface 31 of the rocking cam 27, the rocking cam 27 is turned in the clockwise direction against the biasing force of the resilient member 65, and the opening and closing valve 5 starts opening. The restriction pin 73 is then separated from the stopper 69 of the lock cam 67, the lock cam 67 is turned in the clockwise direction by the biasing force of the resilient member 71, and the tip end of the stopper 69 of the lock cam 67 abuts against the upper surface of the lower fixing wall portion 1L (see FIG. 8(B)).

Therefore, the lock cam 67 is sandwiched between the upper and lower fixing wall portions 1U and 1L and the lock cam 67 is fixed so as not to move. That is, the rocking cam support member 25 and the support shaft 29 are fixed so as not to move in the same manner as that of the above embodiments.

When the rocking cam 27 is further turned in the clockwise direction by the cam 21, the restriction pin 73 is largely separated from the stopper 69 of the lock cam 67 (see FIG. 8(C)), and the fixed states of the rocking cam support member 25 and the support shaft 29 are maintained.

If the cam shaft 19 is further rotated and the pushed state of the rocking cam 27 by the cam 21 is released, the rocking cam 27 is turned in the counterclockwise direction by the effect of energy-storing force of the resilient member 65 and is returned to the state shown in FIG. 8(A).

That is, in the third embodiment, the lock cam 67 is turned in association with the turning motion of the rocking cam 27, and when the opening and closing valve 5 is to be opened, the rocking cam support member 25 and the support shaft 29 are fixed so as not to move. When the opening and closing valve 5 is to be closed, the fixed state is released, the rocking cam support member 25 and the support shaft 29 become movable, and the same effect as the above embodiments can be obtained.

Figure 9:
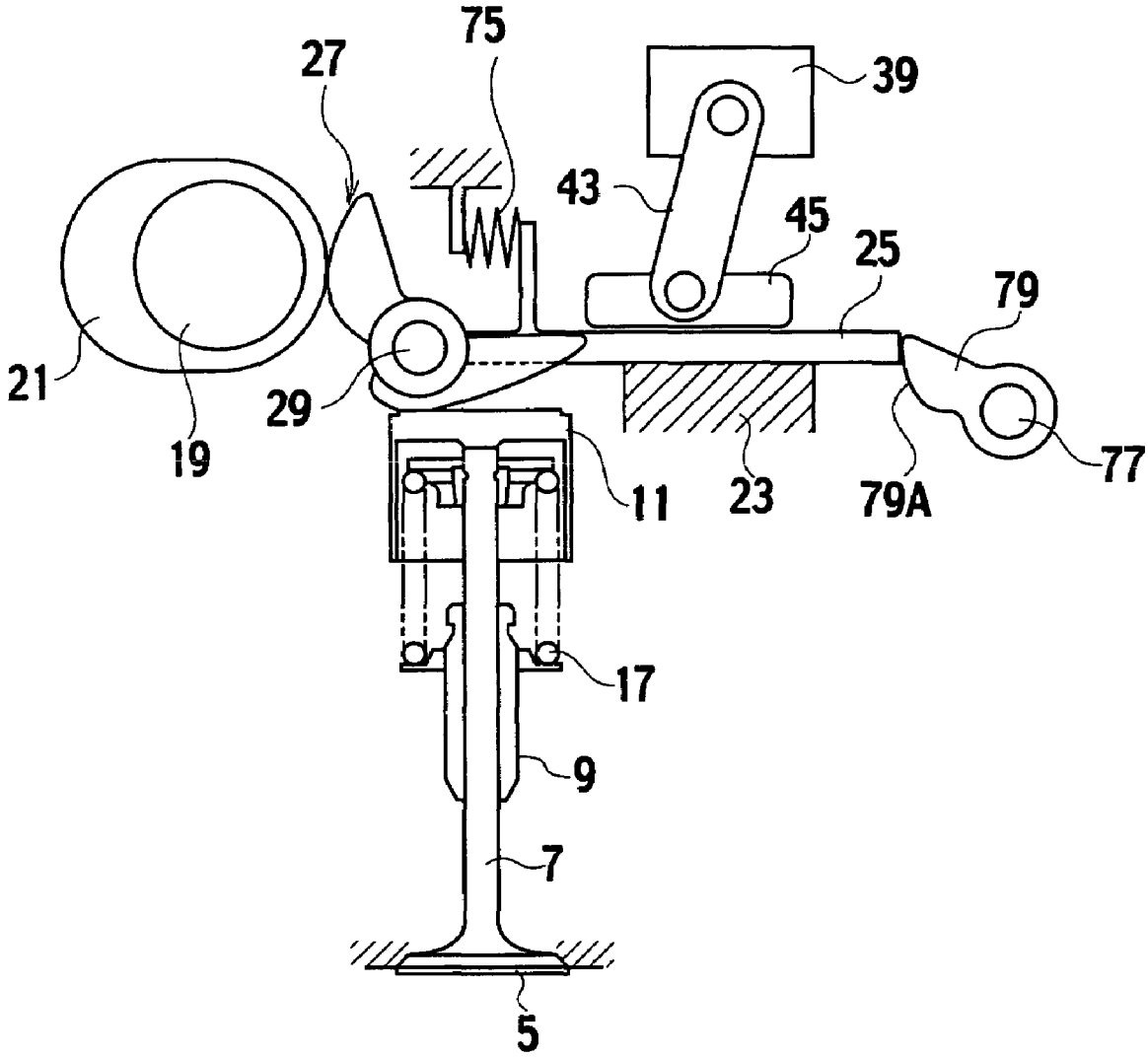
FIG. 9 is a conceptual and schematic explanatory diagram of a configuration according to a fourth embodiment.

FIG. 9 shows a fourth embodiment of the present invention. Like reference signs denote constituent elements having the same functions as those of the above embodiments, and redundant explanation will be omitted.

The fourth embodiment is another embodiment of the rocking position changing unit 35. In the first embodiment, a resilient member 75 such as a spring that biases the rocking cam support member 25 in a direction separating from the cam shaft 19 (right direction in FIG. 9) is provided between a portion of the rocking cam support member 25 and a portion of the cylinder head 1. The fourth embodiment also has a rotatable control shaft 77 and a cam-shaped push moving positioning member 79 that can push the rocking cam support member 25 by a turning motion of the control shaft 77 as a rocking position changing unit that moves and positions the rocking cam support member 25.

The turning motion of the control shaft 77 is controlled by an actuator (not shown) such as a servomotor, and the control shaft 77 is positioned to a desired turning angle. The push moving positioning member 79 includes a cam in which a pushing surface 79A for pushing a base end of the rocking cam support member 25 is formed into an appropriate cam surface, and the push moving positioning member 79 is integrally fixed to the control shaft 77.

With this configuration, when the fixed state of the rocking cam support member 25 by the push-pad 45 is released, if the control shaft 77 is turned in the counterclockwise direction in FIG. 9, the rocking cam support member 25 is moved leftward against the biasing force of the resilient member 75 by the pushing surface 79A of the push moving positioning member 79, that is, the rocking cam support member 25 is moved toward the cam shaft 19.

If the control shaft 77 is turned in the clockwise direction in FIG. 9 on the contrary, since the push moving positioning member 79 is separated from the rocking cam support member 25, the rocking cam support member 25 is moved rightward in FIG. 9 by the biasing force of the resilient member 75, and a movement stop position to the right direction is restricted by the push moving positioning member 79.

Therefore, the rocking cam support member 25 and the support shaft 29 can be laterally positioned by controlling the rotation of the control shaft 77, and the lift amount and the valve timing of the opening and closing valve 5 can be adjusted.

Figure 10:
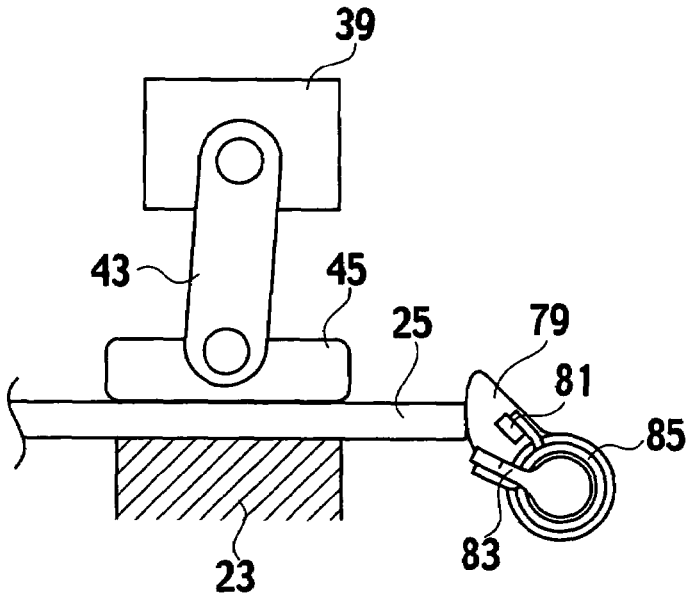
FIGS. 10(A), (B), and (C) are explanatory diagrams of another embodiment of a rocking position changing unit.
Figure 10:
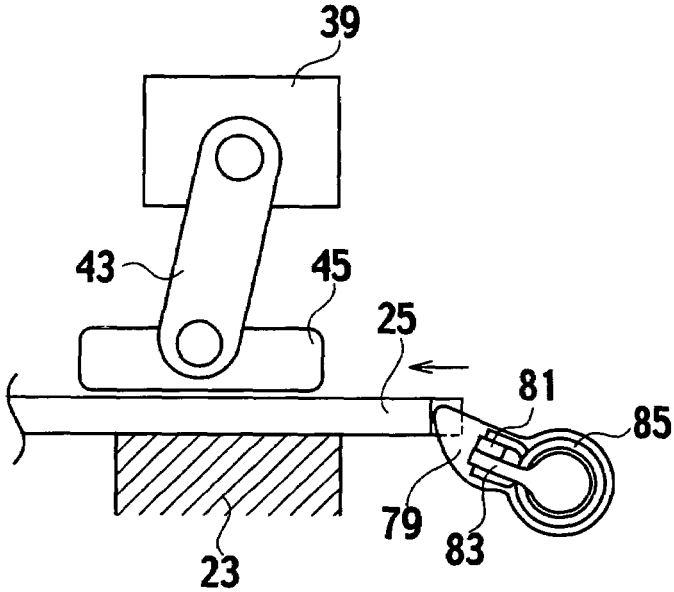
Figure 10:
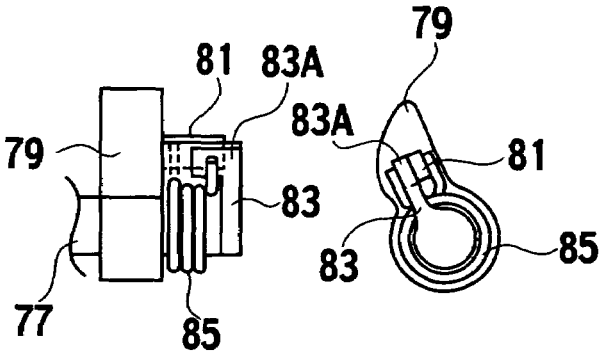

FIGS. 10(A), (B) and (C) show another embodiment of the rocking position changing unit 35 that moves and positions the rocking cam support member 25. The control shaft 77 is turnably provided with the push moving positioning member 79. A stopper arm 83 including, at its tip end, a stopper 83A which can abut against a stopper 81 provided on the push moving positioning member 79, is integrally mounted on the control shaft 77.

A resilient member 85 such as a torsion spring and the like is mounted on the control shaft 77. The resilient member 85 turns the push moving positioning member 79 relative to the control shaft 77 and biases both the stoppers 81 and 83A such that they abut against each other. The resilient member 85 biases the push moving positioning member 79 such that the push moving positioning member 79 turns in the counterclockwise direction in FIGS. 10(A) and (B) relative to the control shaft 77.

With this configuration, when the rocking cam support member 25 is pushed and fixed by the push-pad 45 as shown in FIG. 10(A), if it is attempted to turn the control shaft 77 in the counterclockwise direction to turn and position the push moving positioning member 79, the push moving positioning member 79 is in abutment against the base end of the rocking cam support member 25 and therefore cannot turn.

Therefore, the stopper arm 83 integrally provided on the control shaft 77 relatively turns and separates from the stopper 81 of the push moving positioning member 79, and energy-storing of the resilient member 85 is carried out. If the pushed and fixed state of the rocking cam support member 25 by the push-pad 45 is released, the push moving positioning member 79 is turned in the counterclockwise direction in FIG. 10(A) by the energy-storing force of the resilient member 85, and the rocking cam support member 25 is moved leftward and positioned.

That is, with this configuration, the control shaft 77 can be rotated and positioned at the time of the opening operation of the opening and closing valve 5, the rocking cam support member 25 can be moved swiftly, and the responding speeds of the adjustments of the valve lift and the valve timing of the opening and closing valve 5 can be enhanced.

Figure 11:
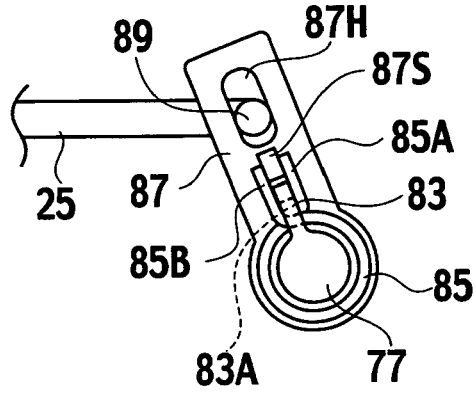
FIGS. 11(A), (B), and (C) are explanatory diagrams of a modification of the configuration shown in FIG. 10.
Figure 11:
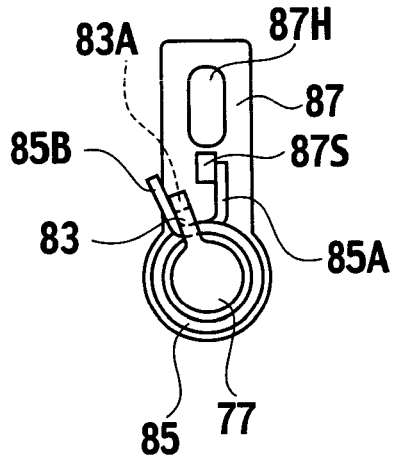
Figure 11:
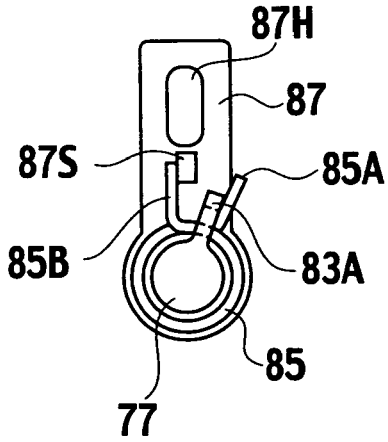

FIGS. 11(A), (B) and (C) show a modification of the above configuration. In the modification, a push moving positioning member 87 which is relatively rotatably supported by the control shaft 77 includes, at its tip end, a long hole 87H which is long in the longitudinal direction. The rocking cam support member 25 includes, at its base end, a connection pin 89 which is inserted into and engaged with the long hole 87H.

The stopper arm 83 which is integrally provided on the control shaft 77 passes through a position inside a stopper 87S of the push moving positioning member 87 and can relatively turn in the clockwise direction and the counterclockwise direction. Both ends 85A and 85B of the resilient member 85 such as a torsion spring mounted on the control shaft 77 sandwich the stopper 87S and the stopper 83A of the stopper arm 83 from both sides.

Therefore, if the control shaft 77 is turned in the counterclockwise direction relative to the push moving positioning member 87, the end 85B of the resilient member 85 is pushed by the stopper 83A of the stopper arm 83 as shown in FIG. 11(B), and the energy is stored such that the push moving positioning member 87 is turned in the counterclockwise direction.

On the contrary, if the control shaft 77 is relatively turned in the clockwise direction, the end 85A of the resilient member 85 is turned in the clockwise direction by the stopper arm 83 as shown in FIG. 11(C), and the energy is stored such that the push moving positioning member 87 is turned in the clockwise direction.

As can be understood from the above explanation, in this embodiment, when the rocking cam support member 25 is fixed, the control shaft 77 can be turned and positioned and the biasing force can be stored in the resilient member 85, and the responding speeds of the adjustments of the valve lift and the valve timing of the opening and closing valve 5 can be enhanced.

Figure 12:
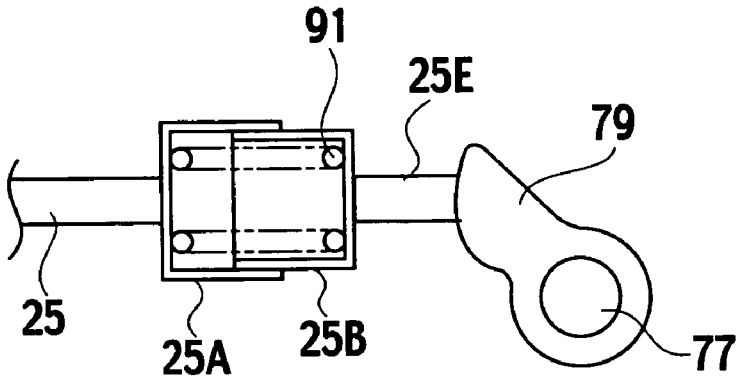
FIGS. 12(A) and (B) are explanatory diagrams of an energy-storing mechanism.
Figure 12:
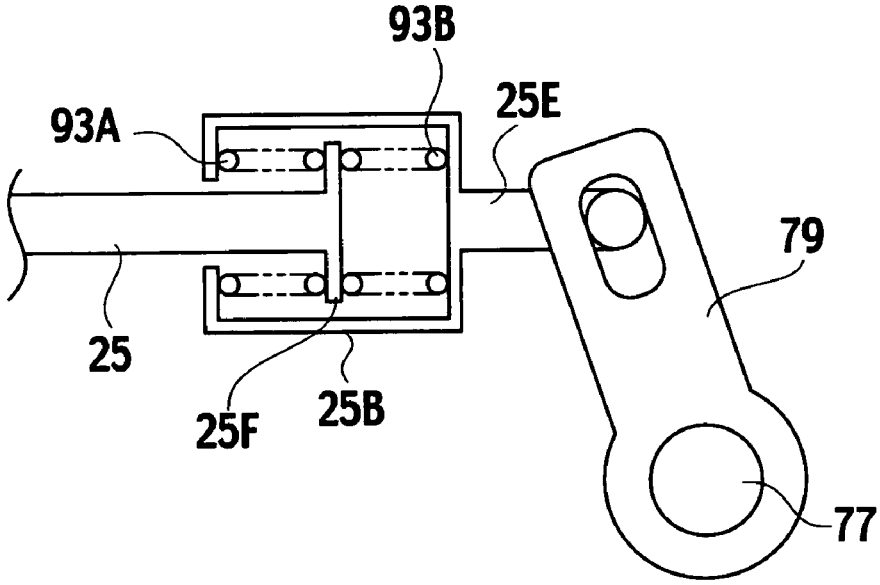

FIGS. 12(A) and (B) show an embodiment in which the rocking cam support member 25 includes an energy-storing mechanism in which the rocking cam support member 25 is fixed, and when the control shaft 77 is turned, energy is stored for moving the rocking cam support member 25.

FIG. 12(A) shows a configuration in which a cup 25B provided on an end member 25E is slidably fitted into a cup 25A provided on an end of the rocking cam support member 25, and a resilient member 91 such as a coil spring is resiliently provided in the cups 25A and 25B.

With this configuration, when the rocking cam support member 25 is fixed, if the push moving positioning member 79 is turned in the counterclockwise direction, the resilient member 91 is compressed, and the biasing force for moving the rocking cam support member 25 leftward is stored.

FIG. 12(B) shows a configuration in which resilient members 93A and 93B such as coil springs are biased in opposite directions from each other, and the resilient members 93A and 93B are opposed to each other between a flange 25F provided on an end of the rocking cam support member 25 and the cup 25B of the end member 25E.

With this configuration, when the rocking cam support member 25 is fixed, if the push moving positioning member 79 is turned in the clockwise direction, the resilient member 93A is compressed and the biasing force for moving the rocking cam support member 25 rightward is stored. Moreover, if the push moving positioning member 79 is turned in the counterclockwise direction on the contrary, the resilient member 93B is compressed and the biasing force for moving the rocking cam support member 25 leftward is stored.

Therefore, with this configuration, the rocking cam support member 25 can be moved swiftly, and the responding speeds of the adjustments of the valve lift and the valve timing of the opening and closing valve 5 can be enhanced.

Figure 13:
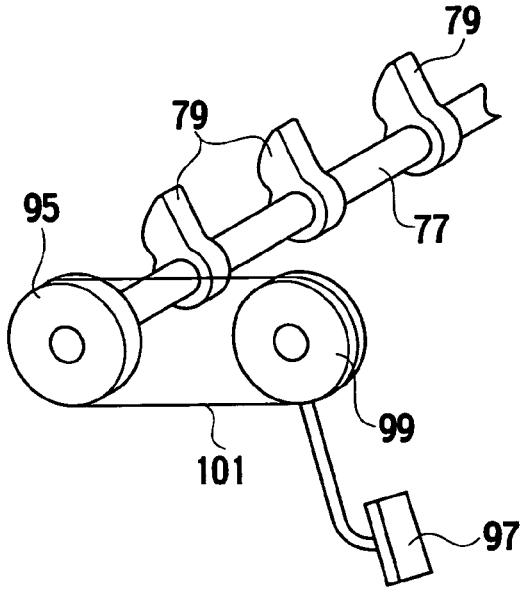
FIGS. 13(A), (B), and (C) are explanatory diagrams of a mechanism for turning a control shaft.
Figure 13:
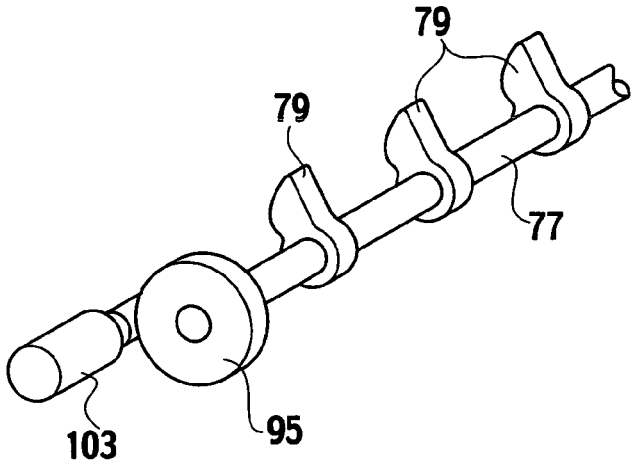
Figure 13:
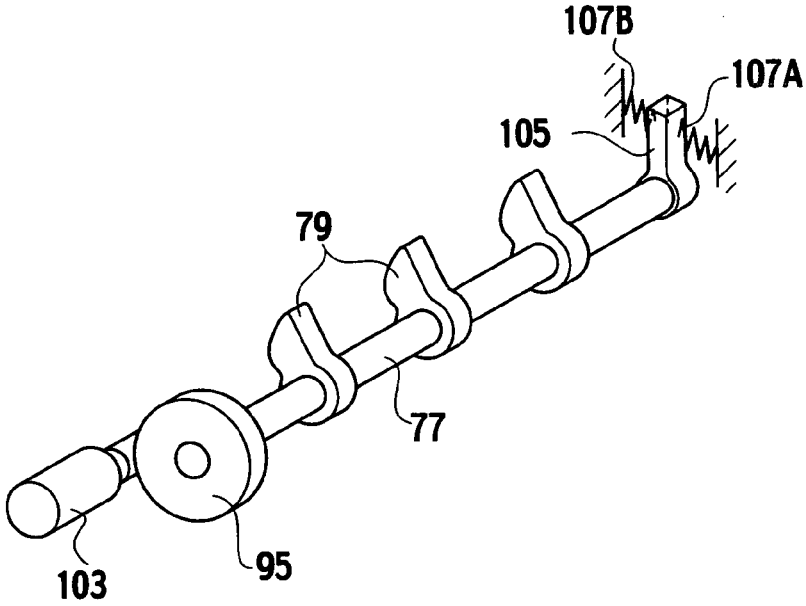

FIGS. 13(A), (B) and (C) show a configuration for turning the control shaft 77. In FIG. 13(A), a manual wire 101 such as an accelerator wire is wound around a pulley 95 provided on an end of the control shaft 77 and a pulley 99 turned and operated by an accelerator pedal 97. Thus, by operating the accelerator pedal 97, the control shaft 77 is turned.

FIG. 13(B) shows an example in which the pulley 95 is turned by an actuator 103 such as a servomotor. FIG. 13(C) shows a configuration in which the control shaft 77 includes a lever 105 at its end, the lever 105 includes resilient members 107A and 107B such as springs at its both ends, and the lever 105 is biased at a neutral position in the configuration shown in FIG. 13(B).

Therefore, with this configuration, when a trouble such as a disconnection occurs and the control shaft 77 cannot be turned by the actuator 103, the control shaft 77 can be held at the neutral position by the effects of the resilient members 107A and 107B, thereby securing safety.

Figure 14:
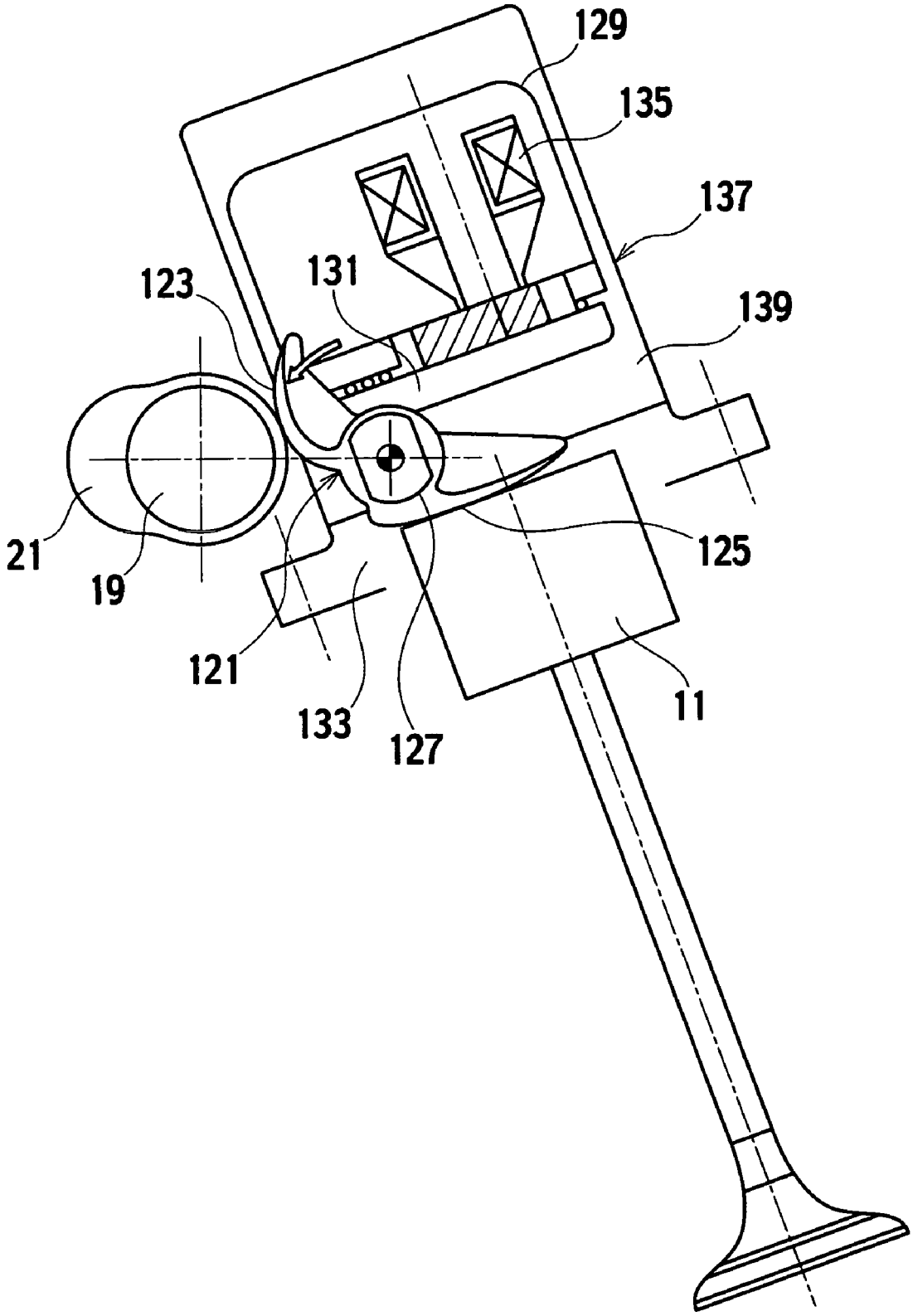
FIG. 14 is a conceptual and schematic partial cross section of a movable valve operating device according to a fifth embodiment of the invention.

FIG. 14 shows a fifth embodiment. Like reference signs denote constituent elements having the same functions as those of the above embodiments, and redundant explanation will be omitted.

A variable valve operating device of the fifth embodiment is mounted on a cylinder head of an engine. The cylinder head includes a rocking cam 121 which is rocked by the cams 21 provided on the cam shaft 19 that transmits rotation of an engine crank.

The rocking cam 121 includes a cam contact surface 123 which is always in contact with the cam 21, and a lifter contact surface 125 which is always in contact with an upper surface of the lifter 11. The cam contact surface 123 and the lifter contact surface 125 are formed with cam profiles for obtaining desired characteristics when the rocking cam 121 rocks.

A rocking cam support member 127 is rotatably supported on both sides of a linear actuator 129 until the rocking cam 121 abuts against a stopper at a predetermined angle. The rocking cam support member 127 is movably provided in a parallel space 139 formed between a movable element 131 which is provided in a linear actuator base housing 137 through a roller such that the movable element 131 can reciprocate and a fixed portion 133 which is integrally provided on the linear actuator 129. The rocking cam support member 127 has a sprag shape as shown in FIG. 15.

Figure 15:
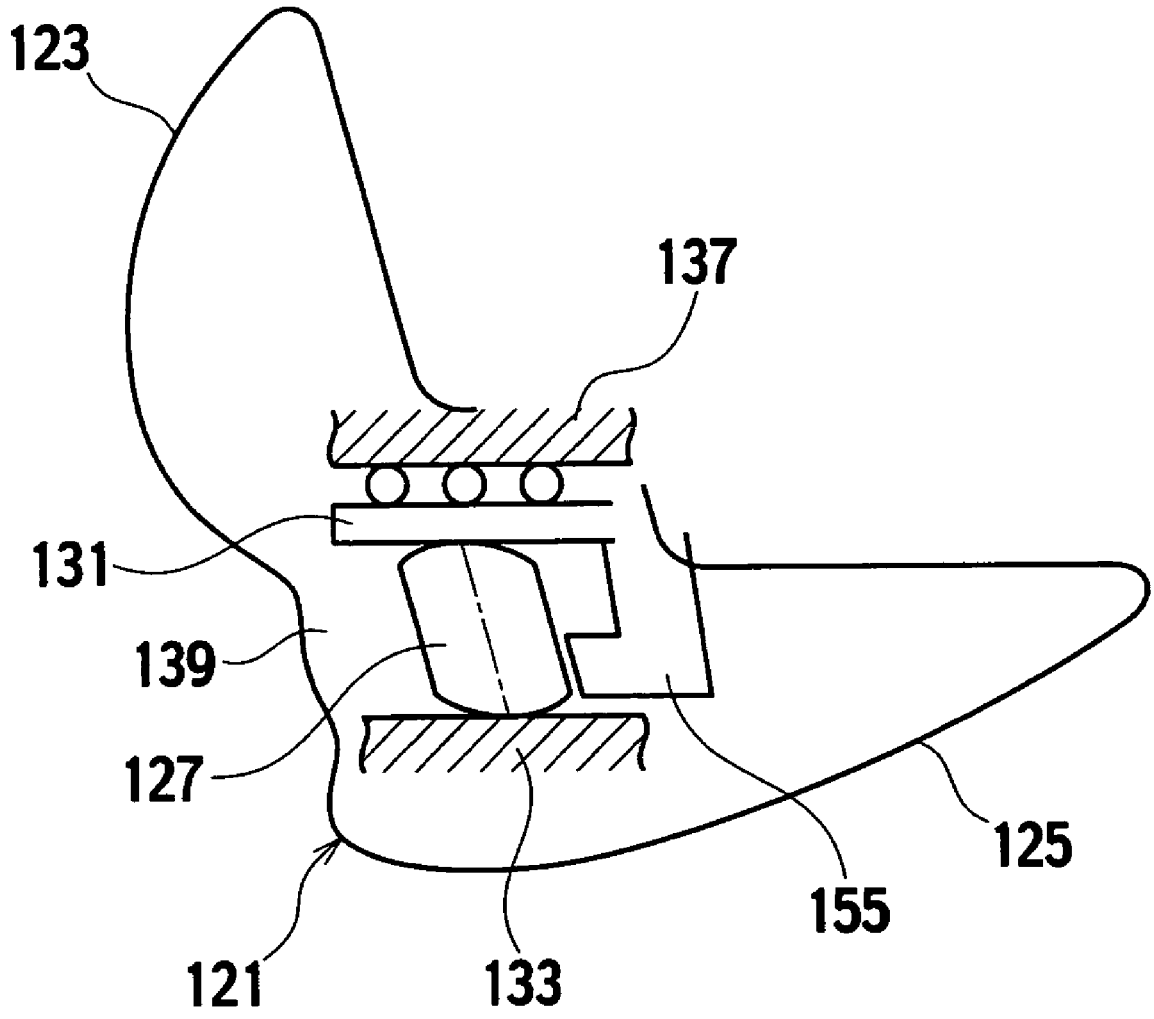
FIG. 15 is an explanatory diagram of the relevant parts.

In FIG. 15, the movable element 131 is integrally formed with a lever 155 which abuts against the rocking cam support member 127.

The linear actuator 129 is a rocking position changing unit that moves the rocking cam support member 127 to change the rocking position of the rocking cam 121. If the linear actuator 129 is energized, the lever 155 connected to the movable element 131 pushes out the rocking cam support member 127, changes its position and stops at an arbitrary position. A rocking motion of the rocking cam 121 is started by a rocking motion of the cam 21, but since the rocking cam support member 127 is fixed in position by the lever 155, the rocking cam 121 assumes a predetermined angle, the rocking cam 121 and the rocking cam support member 127 are integrally combined with each other, and a sprag which receives a lateral load generated in the rocking cam 121 and turns in the clockwise direction is sandwiched between upper and lower walls of the parallel space 139 and is brought into a locked state.

After the sprag is locked, the rotatable rocking cam 121 transmits a rocking motion along a rocking characteristic of the cam 21 to the lifter 11, and opens the valve.

If the sprag is brought into the locked state, even if the energization (supply of electric power) of the linear actuator 129 is stopped, the wedge effect of the sprag maintains the locked state. If the rocking motion (valve opening motion) of the rocking cam 121 is completed, the lateral load applied to the sprag disappears, and the movable element 131 supported by the roller can rotate the sprag in the counterclockwise direction to release the locked state without receiving the influence of friction.

The invention claimed is:

1. A variable valve operating device for an engine to adjust a valve lift and a valve timing of the engine, said variable valve operating device comprising:

a rocking cam which is rocked by a cam provided on a rotatable cam shaft;

a rocking cam support member that rockably supports said rocking cam;

a valve which is opened and closed by a rocking motion of said rocking cam;

a rocking position changing unit that moves said rocking cam support member to change a rocking position of said rocking cam; and a lock unit that can fix said rocking cam support member so as not to move during a valve-opening period of said valve, wherein said lock unit comprises:

a support base that movably supports said rocking cam support member;

an external force applying unit that applies an external force to said rocking cam support member; and a fixing and holding unit that integrally holds said rocking cam support member on said support base when said external force applying unit applies the external force to said rocking cam support member.

2. The variable valve operating device for an engine according to claim 1, wherein said lock unit further comprises: a push-link which is rocked by an actuator and which pushes said rocking cam support member toward said support base when a tip end side of said push-link abuts against said rocking cam support member.

3. The variable valve operating device for an engine according to claim 1, wherein said lock unit further comprises a push-link which is rocked by a switch cam integrally formed on said rocking cam and which pushes said rocking cam support member toward said support base when a tip end side of said push-link abuts against said rocking cam support member.

4. The variable valve operating device for an engine according to claim 2, wherein said tip end side abuts against said rocking cam support member in a state where said push-link is slightly inclined from a vertical state with respect to said rocking cam support member.

5. The variable valve operating device for an engine according to claim 3, wherein said tip end side abuts against said rocking cam support member in a state where said push-link is slightly inclined from a vertical state with respect to said rocking cam support member.

6. The variable valve operating device for an engine according to claim 1, wherein said lock unit further comprises:

a lock cam which can turn in association with a valve opening turning motion of said rocking cam; and a stopper which is pushed against a fixed portion when said lock cam is turned by a predetermined amount.

7. The variable valve operating device for an engine according to claim 1, wherein said rocking position changing unit comprises:

a turnable control shaft; and a push moving positioning member that pushes and moves said rocking cam support member, to position said rocking cam support member by turning said turnable control shaft to change a rocking position of said rocking cam.

8. The variable valve operating device for an engine according to claim 7, wherein:

said push moving positioning member is turnably provided on said turnable control shaft; and a biasing unit that holds said push moving positioning member at a predetermined position is provided between said turnable control shaft and said push moving positioning member.

9. The variable valve operating device for an engine according to claim 7, wherein an energy-storing mechanism that stores energy for moving said rocking cam support member is provided between said push moving positioning member and said rocking cam support member.

10. The variable valve operating device for an engine according to claim 7, wherein a said turnable control shaft includes a plurality of said push moving positioning members equal in number to a plurality of said valves.

11. The variable valve operating device for an engine according to claim 8, wherein said turnable control shaft includes a plurality of said push moving positioning members equal in number to a plurality of said valves.

12. The variable valve operating device for an engine according to claim 9, wherein said turnable control shaft includes a plurality of said push moving positioning members equal in number to a plurality of said valves.

13. The variable valve operating device for an engine according to claim 10, wherein a turning unit that turns said turnable control shaft comprises a manual wire or an actuator.

14. The variable valve operating device for an engine according to claim 11, wherein a turning unit that turns said turnable control shaft comprises a manual wire or an actuator.

15. The variable valve operating device for an engine according to claim 12, wherein a turning unit that turns said turnable control shaft comprises a manual wire or an actuator.

16. A variable valve operating device for an engine to adjust a valve lift and a valve timing of the engine, said variable valve operating device comprising:

a rocking cam which is rocked by a cam provided on a rotatable cam shaft;

a rocking cam support member that rockably supports said rocking cam;

a valve which is opened and closed by a rocking motion of said rocking cam;

a rocking position changing unit that moves said rocking cam support member to change a rocking position of said rocking cam; and a lock unit that can fix said rocking cam support member so as not to move during a valve-opening period of said valve, wherein:

said rocking cam support member is disposed between a movable element which is movably provided on said rocking position changing unit and a support base fixed to said rocking position changing unit; and said rocking cam support member is provided between a restriction surface provided on said movable element and said support base such that said rocking cam support member can be sandwiched and fixed therebetween.

17. The variable valve operating device for an engine according to claim 16, wherein:

said rocking cam support member comprises, at both ends thereof, rocking cams such that said rocking cams can rock; and a cross sectional shape of a central portion of said rocking cam support member comprises:

a narrow portion which is narrower than a distance between said restriction surface of said movable element and said support base portion; and a wide portion which is slightly wider than the distance.

18. The variable valve operating device for an engine according to claim 17, wherein said movable element comprises a positioning portion which can abut against said rocking cam support member at a position away from said restriction surface.

* * * * *